US005371488A

United States Patent [19]

Couch et al.

[11] Patent Number: 5,371,488

[45] Date of Patent: Dec. 6, 1994

[54] TENSION SENSING SECURITY APPARATUS AND METHOD FOR FENCING

[75] Inventors: Irvin W. Couch, Austin; Billy M. Hammer, Round Rock; Keith Couch, Austin, all of Tex.

[73] Assignee: Waymax, Inc., Austin, Tex.

[21] Appl. No.: 69,197

[22] Filed: May 27, 1993

[51] Int. Cl.[5] ..... G08B 13/12

[52] U.S. Cl. ..... 340/541; 340/664; 340/666; 340/668

[58] Field of Search ..... 340/541, 668, 666, 665, 340/664, 657

[56] References Cited

U.S. PATENT DOCUMENTS

| | | | |
|---|---|---|---|
| 2,751,579 | 6/1956 | Phillips et al. | 340/654 |
| 3,655,995 | 4/1972 | Malme | 307/132 R |
| 4,155,083 | 5/1979 | Slaats et al. | 340/666 |
| 4,318,088 | 3/1982 | Hunter | 340/541 |
| 4,367,459 | 1/1983 | Amir et al. | 340/541 |
| 4,500,873 | 2/1985 | Porat et al. | 340/515 |
| 4,518,953 | 5/1985 | Hunter et al. | 340/564 |
| 4,527,150 | 7/1985 | Porat | 340/541 |
| 4,533,906 | 8/1985 | Amir | 340/541 |
| 4,730,809 | 3/1988 | Stoler | 256/1 |
| 4,736,194 | 4/1988 | Sticksel | 340/541 |
| 4,800,366 | 1/1989 | Husmann | 340/524 |
| 4,803,468 | 2/1989 | Seifert | 340/566 |
| 4,810,999 | 3/1989 | Moshier | 340/550 |
| 4,829,287 | 5/1989 | Kerr et al. | 340/541 |
| 5,103,207 | 4/1992 | Kerr et al. | 340/541 |

FOREIGN PATENT DOCUMENTS

| | | |
|---|---|---|
| 1123247 | 9/1956 | France . |
| 2626306 | 7/1989 | France . |
| 2638877 | 5/1990 | France . |

*Primary Examiner*—Glen Swann

*Attorney, Agent, or Firm*—Shaffer & Culbertson

[57] ABSTRACT

The security device receives longitudinal tension from a taut wire of a fence and preferably is placed in-line in the taut wire system away from posts used to support the fence. The security device senses variations in the longitudinal tension in the taut wire and produces a tension signal which is transmitted to a central location when it senses such a tension deviation. The security device may be used in conjunction with a resistance sensing device to provide further protection. The resistance of a conductive loop formed either by the taut wire or by the combination of the taut wire and another conductor is monitored and a resistance signal is produced when it senses either a discontinuity or a variation in the resistance of the loop. The method of the present invention includes steps for receiving the tension in the taut wire and producing a signal when the tension in the taut wire varies more than a triggering amount. Further features of the present invention include anti-tampering arrangements including features that produce a tampering signal when the lid is removed from the device and when an attempt is made to clamp the device to its protective housing.

19 Claims, 3 Drawing Sheets

TENSION SENSING SECURITY APPARATUS AND METHOD FOR FENCING

BACKGROUND OF THE INVENTION

This invention relates to a security apparatus for use with fencing. In particular this invention relates to an apparatus and method for receiving the longitudinal tension in a taut wire associated with a fence and for producing a tension signal when the longitudinal tension in the taut wire changes by a certain magnitude. Further, this invention encompasses an apparatus and method for monitoring both the tension in the taut wire and electrical resistance of an electrically conductive loop that includes the taut wire.

Fencing by itself provided one of the earliest forms of security for containing animals and limiting access to certain areas. In some cases, however, additional security devices are necessary to detect when a person climbs over a fence, when a fence is cut, or when the fence is otherwise tampered with in an attempt to intrude.

Taut wire fencing systems were developed to detect intrusions into a fenced area. U.S. Pats. Nos. 4,829,287 and 5,103,207 to Kerr et al. and No. 4,367,459 to Amir et al., describe such taut wire systems. In these systems, the taut wire was tightly strung between stationary end posts. The taut wire was then firmly attached to at least one group of pole mounted sensors and loosely attached to other support poles. The pole mounted sensors were adapted to produce an alarm signal when the taut wire moved in a transverse direction. An intruder who was attempting to climb over the taut wire fence would cause the taut wire to move and thereby cause the pole mounted sensor to produce an alarm signal.

With these prior taut wire systems, however, all sensors were pole mounted. The systems were easily circumvented by clamping or otherwise isolating the taught wire to adjacent posts such that the taut wire did not change position relative to the sensor. These prior taut wire security systems were also easily circumvented by cutting the taut wire simultaneously on either side of the sensor.

Additionally, these prior taut wire systems were not useful for all applications. For example, these prior systems could not perform the dual functions of confining livestock and preventing human intrusions because inadvertent contact by livestock would produce false trip signals. Further, when these prior taut wire systems were installed in areas with heavy brush and trees, the systems often gave false signals when wind blown brush fell against the fences.

U.S. Pat. No. 4,318,088 to Hunter describes another type of security fence system in which an electrically insulated single-strand wire was strung in multiple parallel paths around a fenced area to form an electrically closed path. The conductors were then electrified at a low voltage and the current through the conductor was monitored. When the parallel lines of the conductor were pushed together to make electrical contact such as by an intruder, the current in the conductor changed producing a sensor signal to activate an alarm.

However, this conductor monitoring device also suffered shortcomings. The electronics required to monitor the current or voltage on the lines required substantial maintenance. Further, variations in weather could cause false tripping signals. Animals could inadvertently trigger the above described device and therefore the system could not be used by itself to contain livestock. Further, because the system only measured the electrical properties of the line, the conductors could be physically displaced some distance without the system triggering. Also, it was possible to jumper the conductors to bypass the system's fence monitoring function.

SUMMARY OF THE INVENTION

It is a general object of the invention to overcome the above described limitations and others of the prior fencing security devices. More particularly, it is an object of the invention to provide a fence security apparatus and method for monitoring the longitudinal tension in a taut wire associated with a fence, particularly livestock fencing.

To accomplish these objects, a security apparatus for use with fencing comprises a tension receiving means and a tension sensing means. The tension receiving means is capable of being connected to a taut wire associated with a fence in position to receive the longitudinal tension in the taut wire. The tension sensing means is associated with the tension receiving means and produces a tension signal in response to a certain deviation in the longitudinal tension in the taut wire as received by the tension receiving means. The tension sensing means produces the tension signal only when the magnitude of the deviation in tension exceeds a trip magnitude. In some forms of the invention, the tension sensing means produces a signal when tension on the taut wire drops such as when the taut wire is cut. Alternatively, the tension sensing means may produce a tension signal when tension in the taut wire increases such as when an intruder puts weight on the wire in attempting to climb over the fence.

Preferably, the above described apparatus is contained in a protective housing which also contains a transmitter for relaying the tension signal and other signals to a remote receiver and monitoring station. The protective housing also includes anti-tampering devices that produce a tamper signal when an intruder removes the lid from the housing or when an intruder attempts to clamp-off the taut wire to the housing. These features serve to prevent the most common forms of tampering.

Additionally, the apparatus according to the invention may be incorporated with an electrical resistance sensing system. In this form of the invention, the taut wire is connected to form part of an electrically conductive loop and the apparatus includes means for sensing the conductivity or resistivity of the loop. When the taut wire or another part of the conductive loop is cut, the sensor detects the change in resistance and produces a signal to be transmitted to the monitoring station.

Because the apparatus of the present invention directly monitors the longitudinal tension of the taut wire and can be adjusted to respond only to relatively large tension deviations without compromising effectiveness, the apparatus significantly reduces false trip signals. Also, since the apparatus of the present invention is installed in-line with the taut wire, and is not post mounted, it is much more difficult to circumvent by clamping. Further, the anti-tampering devices installed on the device prevent the most common forms of tampering without revealing their presence to an intruder. Moreover, because the device may be used in combination with a conductive loop device, an intrusion will be detected by the system even if the intruder is successful in clamping the taut wire off around the apparatus and cutting the taut wire.

These and other objects, advantages, and features of the invention will be apparent from the following description of the preferred embodiments, considered along with the accompanying drawings.

DESCRIPTION OF THE PREFERRED EMBODIMENTS

Figure 1:
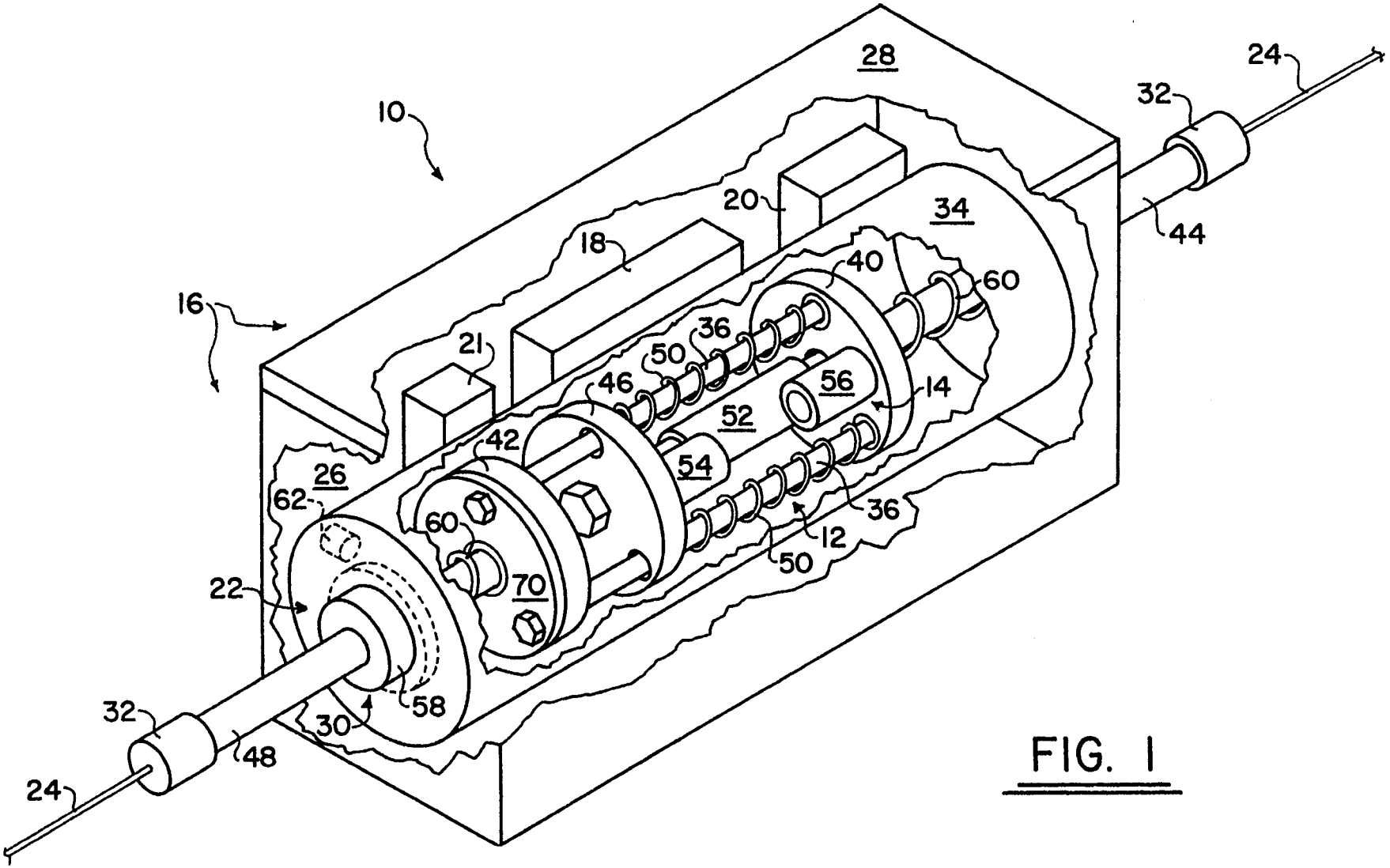
FIG. 1 is a view in perspective of a security apparatus embodying the principles of the present invention partially broken away to showy interior features.

Referring to FIG. 1, a security apparatus 10 for use with fencing comprises tension receiving means 12 and tension sensing means 14 contained substantially within a protective housing 16. Preferably, the apparatus 10 also includes transmitting means 18, lid tampering means 20, a shock sensor 21, and endpiece tampering means 22.

The tension receiving means or device 12 is capable of being connected to a taut wire 24 in a security fencing installation so as to receive the longitudinal tension in the taut wire. Thus, the tension receiving means 12 functions as an in-line element in the taut wire, receiving the tension in the taut wire 24 and holding the tension until the tension releases at a location along the taut wire, such as when a taut wire 24 is cut by an intruder.

The tension sensing means or device 14 is associated with the tension receiving means 12 and produces a tension signal in response to a deviation in the longitudinal tension in the taut wire 24 and the tension receiving means. However, in order to produce a tension signal, the tension sensing means 14 must sense a deviation greater in magnitude than a trip magnitude as measured with respect to a normal longitudinal tension existing in the taut wire 24.

The protective housing 16 encloses the tension sensing means 14 and at least a center portion of the tension receiving means 12. The protective housing 16 comprises an open box 26, a lid 28, and an opening 30 at each end. In this form of the invention a portion of the tension receiving means 12 extends from the protective housing through each end opening 30. Wire connectors 32 firmly attach the tension receiving means 12 to the taut wire 24 at each end of the tension receiving means outside of the box 26. Because the security apparatus 10 is connected as an in-line element in the fence it may be placed anywhere along the fence and not just at the fence posts (not shown). Preferably, the tension receiving means 12 and tension sensing means 14 are both contained within the box 26 in a cylindrical housing 34. The cylindrical housing 34 preferably comprises a rigid plastic material, such as heavy PVC pipe, that is cut to fit within the box 26 and permanently fixed in place. The PVC material resists corrosion, weathers well, and provides additional protection to the tension receiving means 12 and the tension sensing means 14 against the elements and tampering.

The transmitting means 18 is for receiving the tension signal produced by the tension sensing means 14 and for transmitting a fault signal to a monitoring station (not shown) at a remote location in response to the receipt of the tension signal. Preferably the transmitting means 18 is an Inovonics. Inc. model C-200W alarm transmitter or the like. The preferred transmitting means 18 includes a transmitter tamper sensor (not shown) for producing a tamper signal when the transmitting means itself is opened.

In a typical application, many of the devices 10 will be installed on the taut wire 24. Because no communication lines are required for relaying signals, the increase in cost of such an installation increases only by the cost of additional security devices 10. Further, because the security apparatus 10 is self-contained, it may be remotely located and requires servicing very infrequently.

The lid tampering detection means 20 is for producing a sensor signal when the lid 28 is removed from the box 26. As is shown in FIG. 1, the lid tampering detection means 20 preferably is mounted on the side wall of the box 26 in position to sense when the lid 28 has been removed. Preferably, the tampering detection means comprises a proximity sensor, such as the GRI 2020-12 by GRI Telemark Corporation, although one skilled in the art will readily appreciate that any of a number of sensors could be used. As with the tension signal, the transmitting device 18 transmits the lid tamper signal back to the central location and the monitoring station.

Shock sensor 21 is adapted to detect an impact to the device 10 or sudden movement by the device and produce a shock signal in response to the impact or movement. Preferably, the shock sensor comprises a model SP3246 sensor by Terminus Corporation. The transmitting device 18 transmits the shock signal to the central monitoring station to produce an alarm signal at the central station.

Figure 2:
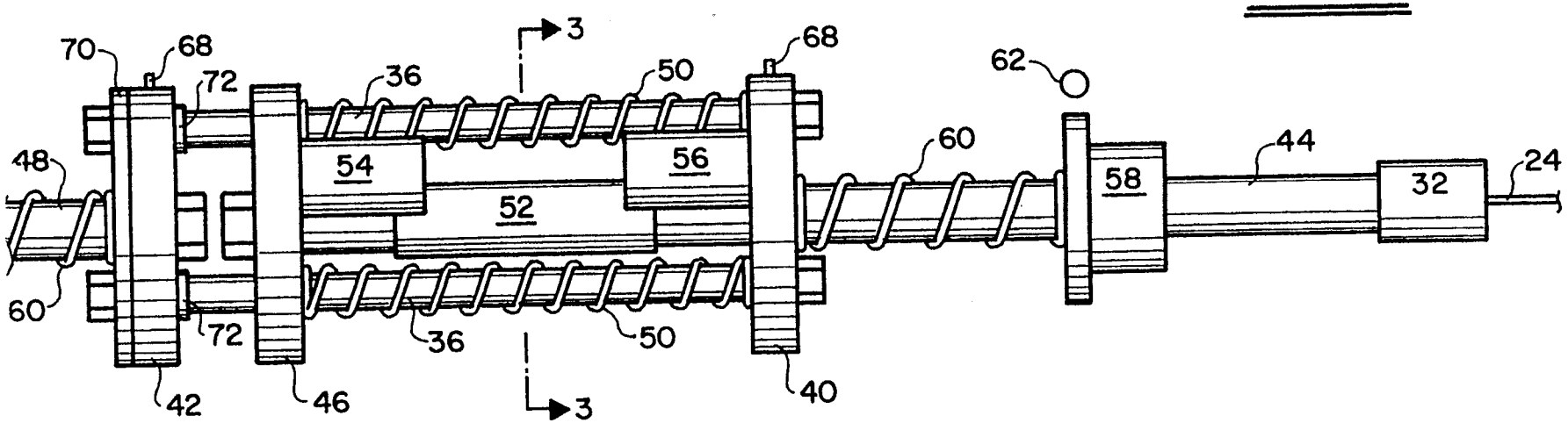
FIG. 2 is a partial side elevation view of the security apparatus of FIG. 1.
Figure 3:
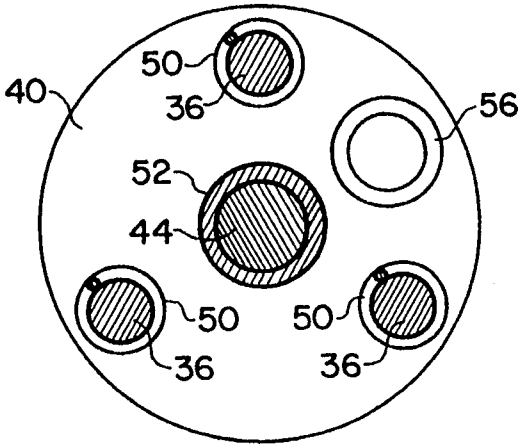
FIG. 3 is a partial transverse sectional view of the security apparatus taken along section 3—3 in FIG. 2.

Referring to FIGS. 1 through 3, the tension receiving means 12 preferably comprises a supporting structure including a plurality of elongated guide members 36 connected to a first end plate 40 at one end and a second end plate 42 at the other end. A first connecting member 48 attaches to the second end plate 42 and one of the wire connectors 32 firmly attaches the first connecting member to the taut wire 24. A moving plate 46 slidably attaches to the elongated guide members 36 between the first end plate 40 and the second end plate 42. The moving plate 46 connects to a second connecting member 44. The other wire connector 32 in turn firmly connects the second connecting member 44 to the taut wire 24 at the other end of the box 26. Biasing means, preferably comprising a plurality of biasing springs 50, biases the moving plate 46 away from the first end plate 40, such biasing opposing the normal longitudinal tension in the taut wire 24.

As is apparent from FIGS. 1 and 2, as the tension receiving means 12 receives tension from the taut wire 24 at each end, the tension forces the moving plate 46 towards the first end plate 40 thereby compressing the biasing springs 50. A spacer sleeve 52 prevents the overtensioning of the tension receiving means 12. The tension receiving means 12 holds the longitudinal tension in the taut wire 24 until the tension in the taut wire releases, allowing the biasing springs 50 to push the moving plate 46 away from the first end plate 40.

Referring to FIGS. 2 and 3, the tension sensing means 14 preferably comprises a first tension sensor element 54 attached to the moving plate 46 and a second tension sensor element 56 attached to the first end plate 40. The tension sensor elements 54 and 56 are adapted to produce the tension signal when the first tension sensor element 54 moves out of a tension sensor proximity from the second tension sensor element 56. Preferably, the tension sensor elements 54 and 56 comprise, respectively, a magnet and a magnetically activated switch, such as the GRI 2020-12 model sensor by GRI Telemark Corporation. The distance between sensor elements 54 and 56 required to produce a tension signal may be as little as $\frac{3}{8}$ of an inch.

Referring again to the FIGS. 1 and 2, the apparatus according to the present invention also preferably includes the endpiece tampering means 22 which is an anti-clamping feature. The endpiece tampering means 22 comprises a housing endpiece 58 slidably mounted over at least one of the connecting members 44 or 48, preferably both, and slidably mounted within the respective end opening 30 of the box 26. In other forms of the invention the endpieces may cover the entire end of the box 26 or other protective housing. Associated with each housing endpiece 58 is an endpiece biasing means preferably comprising biasing springs 60 for biasing each housing end piece outwardly with respect to the box 26. The endpiece tampering means 22 further comprises an endpiece sensor 62 associated with at least one housing endpiece 58 for producing an endpiece tamper signal in response to movement of either endpiece slidably against the biasing spring 60. Preferably, the housing endpieces 58 are partially constructed of or include a magnetic material and the endpiece sensor 62 is designed to detect the presence or absence of the magnetic material within a certain proximity. With this arrangement, if an intruder attempts to clamp off the tension receiving means 12 by pushing in the housing end piece 58 and clamping the connecting members 44 and 48 using the box 26 for support, the endpiece sensor produces a signal to be transmitted by the transmitter 18.

In the form of the invention in which the tension sensing means 14 produces a signal when the taut wire 24 is cut, the switch 56 may be closed when the magnet 54 is within the sensor proximity. When the tension in the wire decreases sufficiently to move the magnet 54 out of the activating distance of switch 56, the switch to opens. The open circuit then serves as the tension signal. When the tension sensing means 14 is adapted to produce a signal when an intruder puts weight on the taut wire, the switch 56 may be closed until the magnet 54 is pulled by the wire tension to within the activating proximity of the switch at which point the switch opens to produce the desired tension signal.

Figure 4:
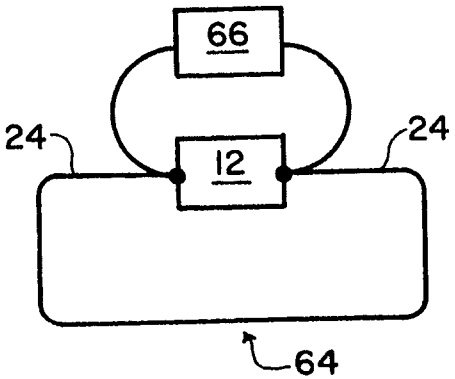
FIG. 4 is an electrical schematic diagram showing the security apparatus used in conjunction with a resistance sensor and a conductive loop formed by a taut wire.

The present invention may be used in conjunction with a conductive loop 64 to provide additional security. Referring to FIG. 4, when the security apparatus 10 includes the resistance sensing aspect, the taut wire 24 comprises an electrically conductive material and the apparatus further includes a resistance sensor 66 for producing a resistance signal in response to a change in the resistance of the conductive loop 64. In this arrangement, the taut wire 24 forms a portion of the conductive loop 64 and the conductive loop terminates at each end of the tension receiving means 12.

The resistance sensor 66 measures or detects the resistance or conductivity of the loop across the tension receiving means 12 by connecting to terminals 68, one of which is attached to the first end plate 40 and the other is attached to the second end plate 42 as shown in FIG. 2. The first end plate 40 and the second end plate 42 are preferably electrically isolated from one another by the inclusion of an insulating endplate 70 and insulating sleeves 72 that surround the elongated guide members 36 near the second end plate. Preferably, the insulating endplate 70 is formed of high impact plastic and the insulating sleeves are formed of plastic tubing. Thus, the resistance or conductivity across the first end plate 40 and the second end plate 42 comprises the resistance or conductivity of the conductive loop 64 which includes the taut wire 24. The resistance sensor 66 preferably produces a resistance signal when it senses any discontinuity in the conductive loop 64, which may be caused by a cut or break in the taut wire. Alternately, a resistance sensor 66 could be employed that produces a signal when the resistance of the conductive loop 64 changes by a certain magnitude, such as when the loop may be jumpered. Further, multiple security devices 10 may be connected to a taut wire in a single conductive loop by eliminating the resistance sensor 66 and the insulating material in all but one of the devices 10.

Figure 5:
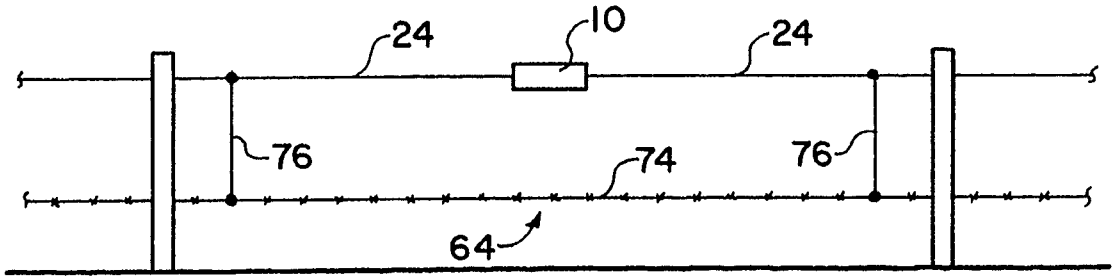
FIG. 5 is a diagrammatic view of the security apparatus used in conjunction with a conductive loop formed by a taut wire and a second conductor running substantially parallel to the taut wire.

As shown in FIG. 5, a secondary wire 74 may be connected to the fence and extend substantially parallel to the taut wire 24 to form part of the conductive loop 64. In this fashion, additional protection is provided by the dual conductors associated with the fence. To an intruder, it may appear that cutting the parallel secondary wire 74 would not trigger the security apparatus 10 and an alarm would not sound. However, if the intruder simply cuts the secondary wire 74 without disturbing the security apparatus 10, the device still produces a signal. FIG. 5 diagrammatically depicts the taut wire 24 with the apparatus 10 connected therein. The taut wire 24 may comprise a high tensile strength strand of piano wire and the secondary, wire 74 may comprise a length of ordinary barbed wire strung on the fence and jumpered to the wire 24 with suitable conductors 76.

Figure 6:
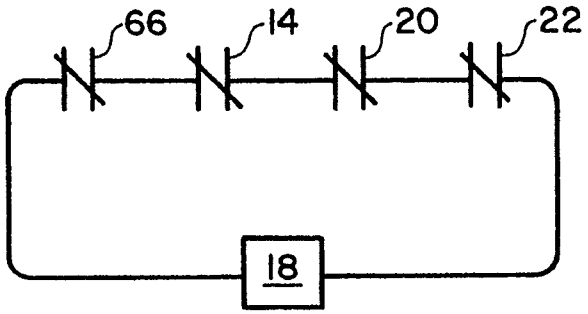
FIG. 6 is an electrical schematic diagram showing a preferred manner of connecting the sensors to the transmitting means.

FIG. 6 provides a schematic depiction of the preferred manner of connecting the sensors of the present invention to the transmitting means 18. Preferably, the tension sensing means 14, the lid tampering means 20, the endpiece tampering means 22, and the resistance sensor 66 provide output circuitry that is electrically closed during normal operation. Further, such output circuitry preferably becomes electrically open when the respective sensor detects a fault or tampering. As shown in FIG. 6, preferably, these devices are connected electrically in series with the combination connected as an input to the transmitting means 18. During normal operation, the transmitting means 18 preferably transmits a normal signal. However, when any of the sensor outputs becomes electrically open, the transmitting means 18 transmits an alarm signal. Alternatively, where the resistance sensor is not used, all of the sensors may be normally open and connected in parallel to the transmitting means. This normal open position is preferred where the shock sensor 21 is employed in the device 10.

The present invention also includes a method for detecting intrusions through fencing and detecting tampering with fencing. The method comprises first applying the longitudinal tension of the taut wire 24 associated with a fence to a tension receiving element 12. The next step comprises producing a tension signal in response to a deviation in the longitudinal tension in the taut wire 24 as received by the tension receiving element 12 where such deviation is greater in magnitude than a trip magnitude as measured with respect to a normal longitudinal tension in the taut wire. The method further comprises the step of transmitting a fault signal to a remote location in response to the tension signal.

With the particular embodiment of the apparatus shown in FIGS. 1 through 3, the tension signal is produced when the first tension sensor element 54 moves out of a tension sensor proximity from the second tension sensor element 56 as the tension on the tension receiving element 12 deviates a certain magnitude from the normal tension.

The method of the invention also preferably includes producing a signal when the lid 28 is removed from the box 26 which houses at least a portion of the tension receiving means 12 and the tension sensing means 14. Another step to prevent tampering includes producing the endpiece tamper signal in response to a movement of at least one of the housing endpieces 58 inwardly with respect to the open box 26.

In one form of the invention the method also includes steps for using the conductive loop 64 in conjunction with the security apparatus 12 to provided further security. In this form, the method includes the further steps of sensing the resistance of the conductive loop 64 which includes the taut wire 24 and producing a resistance signal in response to a change in the resistance or conductivity of the conductive loop. The above described preferred embodiments are intended to illustrate the principles of the invention, but not to limit the scope of the invention. Various other embodiments and modifications to these preferred embodiments may be made by those skilled in the art without departing from the scope of the following claims. For example, although the device may be connected to a taut wire running parallel to strands of barbed wire, the device may be used with other types of fencing systems such as chain link fencing. When used with chain link fencing, the taut wire may be run separately from the chain link or woven through the chain link material when no resistance loop is used. Also, an equivalent tension receiving means 12 may comprise any suitable elastically deformable material and the tension sensing means may comprise a suitable strain gauge associated with the elastically deformable material.

We claim:

1. A security apparatus for use with fencing, the security apparatus comprising:

(a) tension receiving means capable of being connected to a taut wire associated with a fence for being stressed responsive to longitudinal tension in the taut wire; and (b) tension sensing means associated with the tension receiving means for monitoring the stress in the tension receiving means resulting from the longitudinal tension in the taut wire to produce a tension signal in response to a deviation in the longitudinal tension in the taut wire when such deviation is greater in magnitude than a trip magnitude as measured with respect to a normal longitudinal tension.

2. The apparatus of claim 1 further comprising:

(a) transmitting means for receiving the tension signal and for transmitting a fault signal to a remote location in response to the receipt of the tension signal.

3. The apparatus of claim 1 further comprising:

(a) a protective housing for enclosing the tension sensing means and at least a center portion of the tension receiving means.

4. The apparatus of claim 3 wherein the protective housing comprises:

(a) a lid for covering an opening in the protective housing; and (b) lid tampering detection means for producing a lid tamper signal when the lid is removed.

5. The apparatus of claim 3 further comprising:

(a) a first connecting member extending from a first end opening of the protective housing for connecting the tension receiving means to the taut wire;

(b) a second connecting member extending from a second end opening of the protective housing for connecting the tension receiving means to the taut wire;

(c) a first housing endpiece slidably mounted over the first connecting member and slidably mounted within the first end opening of the protective housing;

(d) a second housing endpiece slidably mounted over the second connecting member and slidably mounted within the second end opening of the protective housing;

(e) endpiece biasing means for biasing each housing end piece outwardly with respect to the protective housing; and (f) endpiece sensing means associated with the housing endpieces for producing and endpiece tamper signal in response to movement of either endpiece slidably against the endpiece biasing means.

6. The apparatus of claim 3 further comprising:

(a) shock sensing means associated with the protective housing for producing a shock signal in response to a sudden force applied to the protective housing.

7. The apparatus of claim 1 wherein the taut wire is made of electrically conductive material and further comprising:

(a) resistance sensing means for producing a resistance signal in response to a change in the resistance of a conductive loop which includes the taut wire.

8. The apparatus of claim 7 wherein:

(a) the conductive loop includes a secondary wire connected to the fence and extending substantially parallel to the taut wire.

9. The apparatus of claim 1 wherein the tension sensing means includes:

(a) a first tension sensor element; and (b) a second tension sensor element adapted to produce the tension signal when the first tension sensor element moves out of a normal proximity from the second tension sensor element.

10. The apparatus of claim 1 wherein the tension receiving means comprises:

(a) a supporting structure including a plurality of elongated guide members having stops on one end and connected to a first end plate at the other end;

(b) a second end plate attached to the elongated guide members and connected to a first connecting member, the first connecting member adapted to connect to a first end of the taut wire;

(c) a moving plate slidably attached to the elongated guide members between the first end plate and the second end plate, the moving plate connected to a second connecting member adapted to connect to a second end of the taut wire; and (d) biasing means for biasing the moving plate away from the first end plate against the normal longitudinal tension in the taut wire.

11. The apparatus of claim 10 wherein the tension sensing means comprises:

(a) a first tension sensor element attached to the moving plate; and (b) a second tension sensor element attached to the first end plate and adapted to produce the tension signal when the first tension sensor element moves out of a normal proximity from the second tension sensor element.

12. A security apparatus for use with fencing, the security apparatus comprising:

(a) a tension receiving member adapted to be connected to a taut wire associated with the fence so as to be stressed responsive to a longitudinal tension in the taut wire; and (b) a tension sensing device associated with the tension receiving member to monitor stress on the tension receiving member produced by the longitudinal tension in the taut wire so as to detect a change in the longitudinal tension in the taut wire.

13. The apparatus of claim 12 further comprising:

(a) a radio transmitter associated with the tension sensing device to signal a change in the longitudinal tension in the taut wire.

14. A method for detecting intrusions through fencing, the method comprising the steps of:

(a) applying the longitudinal tension in a taut wire associated with a fence to a tension receiving element so as to stress the tension receiving element; and (b) producing a tension signal in response to a deviation in the stress in the tension receiving element when such deviation is greater in magnitude than a trip magnitude as measured with respect to a normal longitudinal tension in the taut wire.

15. The method of claim 14 further comprising the step of:

(a) transmitting a fault signal to a remote location in response to the tension signal.

16. The method of claim 14 wherein the step of producing a tension signal includes:

(a) producing a tension signal when a first tension sensor element moves out of a normal proximity from a second tension sensor element.

17. The method of claim 14 further comprising the step of:

(a) producing a lid tamper signal when a lid is removed from an opening in a protective housing, the protective housing adapted to enclose a tension sensing device and at least a center portion of the tension receiving element.

18. The method of claim 14 further comprising the step of:

(a) producing an endpiece tamper signal in response to a movement of a housing endpiece, the housing endpiece slidably mounted within an end opening of a protective housing and adapted to allow the tension receiving element to receive tension from the taut wire through the housing endpiece.

19. The method of claim 14 further comprising the steps of:

(a) sensing the resistance of a conductive loop which includes the taut wire; and (b) producing a resistance signal in response to a change in the resistance of the conductive loop which includes the taut wire.

* * * * *